US011014394B2

(12) United States Patent
Josten et al.

(10) Patent No.: US 11,014,394 B2
(45) Date of Patent: May 25, 2021

(54) METHOD FOR PRODUCING A PRINTED PLASTISOL OR LACQUER LAYER

(71) Applicant: OLBRICH GmbH, Bocholt (DE)

(72) Inventors: Andre Josten, Bocholt (DE); Dirk Robeling, Bocholt (DE); Frans Te Welscher, Bocholt (DE)

(73) Assignee: OLBRICH GmbH

( * ) Notice: Subject to any disclaimer, the term of this patent is extended or adjusted under 35 U.S.C. 154(b) by 0 days.

(21) Appl. No.: 16/612,843

(22) PCT Filed: Jan. 17, 2019

(86) PCT No.: PCT/EP2019/051147
§ 371 (c)(1),
(2) Date: Nov. 12, 2019

(87) PCT Pub. No.: WO2019/211008
PCT Pub. Date: Nov. 7, 2019

(65) Prior Publication Data

US 2020/0198388 A1 Jun. 25, 2020

(30) Foreign Application Priority Data

May 2, 2018 (DE) ..... 102018110522.3

(51) Int. Cl.
*B41M 5/00* (2006.01)
*B41M 7/00* (2006.01)
*B41J 11/00* (2006.01)

(52) U.S. Cl.
CPC ..... *B41M 7/0027* (2013.01); *B41J 11/002* (2013.01); *B41M 5/00* (2013.01)

(58) Field of Classification Search
CPC .. B41M 7/0027; B41M 7/009; B41M 5/0011; B41M 5/0047; B41M 5/0064; B41M 7/0081; B41J 11/002
See application file for complete search history.

(56) References Cited

U.S. PATENT DOCUMENTS 8,133,539 B2 * 3/2012 Oberski ..... B41J 11/002 427/287
9,885,188 B2 * 2/2018 Clement ..... B29C 65/48
(Continued)

FOREIGN PATENT DOCUMENTS

EP 2249971 B1 9/2014
EP 3335897 A1 6/2018
(Continued)

OTHER PUBLICATIONS

International Search Report (in English and German) and Written Opinion (in German) issued in PCT/EP2019/051147, dated Jun. 14, 2019; ISA/EP.

*Primary Examiner* — Huan H Tran
(74) *Attorney, Agent, or Firm* — Harness, Dickey & Pierce, P.L.C.

(57) ABSTRACT

A method for producing a printed plastisol or lacquer layer, includes:
- providing a web-shaped carrier with a release coating and/or a surface with a releasing property;
- applying a flowable, preferably liquid or sol-like plastisol or lacquer layer to the release coating and/or the surface with releasing property;
- contactless printing the flowable plastisol or lacquer layer; and
- curing of the printed plastisol or lacquer layer.

15 Claims, 4 Drawing Sheets

(56) References Cited

U.S. PATENT DOCUMENTS

| | | | |
|---|---|---|---|
| 2007/0231525 | A1 | 10/2007 | Bodwell et al. |
| 2016/0297223 | A1 | 10/2016 | Langenscheidt et al. |
| 2018/0079201 | A1 | 3/2018 | Landa et al. |
| 2018/0147583 | A1 | 5/2018 | Josten et al. |
| 2019/0375222 | A1* | 12/2019 | Hamilton ..... B41M 5/0047 |

FOREIGN PATENT DOCUMENTS

| | | | |
|---|---|---|---|
| WO | WO-2008061930 | A1 | 5/2008 |
| WO | WO-2015140682 | A1 | 9/2015 |

* cited by examiner

METHOD FOR PRODUCING A PRINTED PLASTISOL OR LACQUER LAYER

CROSS-REFERENCE TO RELATED APPLICATIONS

This application is a 371 U.S. National Phase of International Application No. PCT/EP2019/051147, filed on Jan. 17, 2019, which claims the benefit of German Application No. 10 2018 110 522.3, filed on May 2, 2018. The entire disclosures of the above applications are incorporated herein by reference.

BACKGROUND

This section provides background information related to the present disclosure which is not necessarily prior art.

TECHNICAL FIELD

The invention relates to a method for producing a printed plastisol or lacquer layer.

DISCUSSION

Printed plastisol or lacquer layers are used, for example, for the production of wall coverings with digitally printed decor or for the production of floor coverings. From WO 2015/140682 A1, it is known to digitally print polymer carriers. Ink anchoring and color homogeneity are quality criteria for printing. In the case of polymer carriers in particular, homogeneous surface properties are desirable, irrespective of the ink used, in order to prevent defect patterns due to local wetting irregularities ("island formation"), a lack of abrasion resistance and color non-uniformities resulting therefrom.

A method for ink jet printing on a non-absorbent substrate is known from EP 2 249 971 B1. Another method for producing a surface coating, in which a liquid material layer is printed before a curing step, is known from the subsequently published EP 3 335 897 A1.

A major disadvantage of the methods known from the state of the art, such as printing on a PVC plastisol layer previously applied to a carrier substrate, is the thermal treatment of the PVC plastisol required for gelling or curing. This requires, for example, that the respective carrier is exposed to the gelling temperature of typically 140° C.-160° C. However, the polymer carrier substrates used in many products, such as floor coverings, are not mechanically stable or processable in this temperature range. Examples of such unsuitable carriers are 50-250 μm thick calendered S-PVC films for the production of Luxury Vinyl Tiles (LVT) or PVC/PET films used in the decorative sector.

SUMMARY

This section provides a general summary of the disclosure, and is not a comprehensive disclosure of its full scope or all of its features.

It is therefore an aspect of the invention to propose a method for producing a printed plastisol or lacquer layer which allows the printed plastisol or lacquer layer to be applied to temperature-sensitive substrates which are not stable or processable at the temperatures required for curing the plastisol or lacquer layer.

Accordingly, it is provided that the method comprises:

- providing a web-shaped carrier with a release coating and/or a surface with a releasing property;
- applying a flowable, preferably liquid or sol-like plastisol or lacquer layer to the release coating and/or the surface with releasing property;
- contactless printing the flowable plastisol or lacquer layer; and
- curing of the printed plastisol or lacquer layer.

The printed plastisol or lacquer layer can thus be produced independently of the carrier substrate on which the printed plastisol or lacquer layer can be applied, particularly for decorative purposes, in a subsequent step. As a result, the thermal treatment of the plastisol or lacquer layer, in particular a corresponding gelling step, a curing step or a drying step, takes place without thermal loading of the substrate. After curing the printed plastisol or lacquer layer, it can be fed inline to a laminating device, where it is laminated onto a carrier substrate which may be temperature-sensitive. Alternatively, the printed plastisol or lacquer layer can be stored on the web-shaped carrier until further processing, for which purpose it is e.g. wound onto a take-up reel with the web-shaped carrier.

Providing a web-shaped carrier with a release coating and/or a surface with releasing property may comprise providing a release liner or a revolving transfer belt. The release liner or the revolving transfer belt can have a silicone-containing coating as release coating. The release coating and/or the surface with releasing property are not limited to any particular embodiments. In particular, the release coating does not necessarily have to be a separate layer from the web-shaped carrier. The release coating can be obtained by conditioning the web-shaped carrier with adhesion-reducing materials, e.g. by siliconizing a carrier fabric belt. Only a non-adhesive or releasing property between the surface of the carrier and the plastisol or lacquer layer is essential. For example, stainless steel belts are known to allow the detachment of a cured plastisol or lacquer layer without applying a releasing layer.

When curing, the printed plastisol or lacquer layer can be heated to more than 130° C. and preferably to more than 150° C.

Contactless printing the flowable plastisol or lacquer layer can comprise a digital printing, such as an inkjet printing or a laser printing.

When applying a flowable plastisol or lacquer layer, a UV lacquer layer can be applied which is cured by UV radiation after contactless printing. Alternatively or additionally, applying a flowable plastisol or lacquer layer can comprise applying a sol-like PVC plastisol layer, which is heated to a temperature of preferably more than 130° C. when curing, which may involve gelation of the sol-like plastisol layer. Alternatively, when applying a flowable plastisol or lacquer layer, an aqueous lacquer layer can be applied which is cured by drying after the contactless printing.

After curing the printed plastisol or lacquer layer, an adhesion primer can be applied to the printed and cured plastisol or lacquer layer and then dried. The adhesion primer can be applied to the side of the plastisol or lacquer layer that has been printed when printing. It can be used to improve the adhesion of the plastisol or lacquer layer to a clear film or wear protection film.

After curing the printed plastisol or lacquer layer, the web-shaped carrier with the plastisol or lacquer layer applied to it can be provided on a take-up reel for subsequent processing.

After curing, the printed plastisol or lacquer layer on the web-shaped carrier can be fed to a laminating device and can be laminated onto a substrate using the laminating device. Since the substrate is not exposed to the temperatures used for curing the plastisol or lacquer layer, it is possible to control the dimensions of the substrate, which may be temperature-sensitive, which is an essential prerequisite for embossing in the register frequently following lamination, e.g. for the production of floor coverings, such as LVTs. The method can therefore comprise embossing the laminate after laminating the cured and printed plastisol or lacquer layer onto a substrate.

Before laminating or when laminating, the plastisol or lacquer layer can be detached and removed from the web-shaped carrier. In an alternative embodiment, the web-shaped carrier can stay on the plastisol or lacquer layer and can be laminated with the plastisol or lacquer layer to the substrate, as an intermediate layer between the plastisol or lacquer layer and the substrate.

Laminating the plastisol or lacquer layer onto the substrate may comprise laminating the plastisol or lacquer layer onto a clear film and/or onto the substrate of a floor covering. For this, the clear layer can be laminated onto the plastisol or lacquer layer, the plastisol or lacquer layer being arranged in the produced laminate between the substrate and the clear film.

Laminating the printed plastisol or lacquer layer onto the substrate can be carried out at a temperature of the laminating device of less than 130° C. and preferably at a temperature of less than 110° C. with the substrate e.g. thermally plasticized. When printing, an ink can be introduced into the flowable plastisol or lacquer layer. Alternatively, an adhesive property without thermal plastification can be used, e.g. a hot melt. Printing can, for example, comprise a digital printing. The digital printing can be configured for example as a laser printing or as an ink jet printing.

If the flowable plastisol or lacquer layer is a plastisol layer, curing of the printed plastisol layer may comprise gelling the printed plastisol layer, stabilizing the ink in the gelled plastisol layer.

When providing a web-shaped carrier with a release coating and/or a surface with releasing property, e.g. a siliconised paper, textile or fabric may be provided onto which when applying a PVC plastisol is applied, which is gelled after printing when curing.

When providing, a web-shaped carrier without release coating and/or surface with releasing property may be provided, which is retained as a layer of a multilayer laminate after printing and curing when laminating.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Further details of the invention are explained using the figures below. The following figures show:

DETAILED DESCRIPTION

Example embodiments will now be described more fully with reference to the accompanying drawings.

Figure 1:
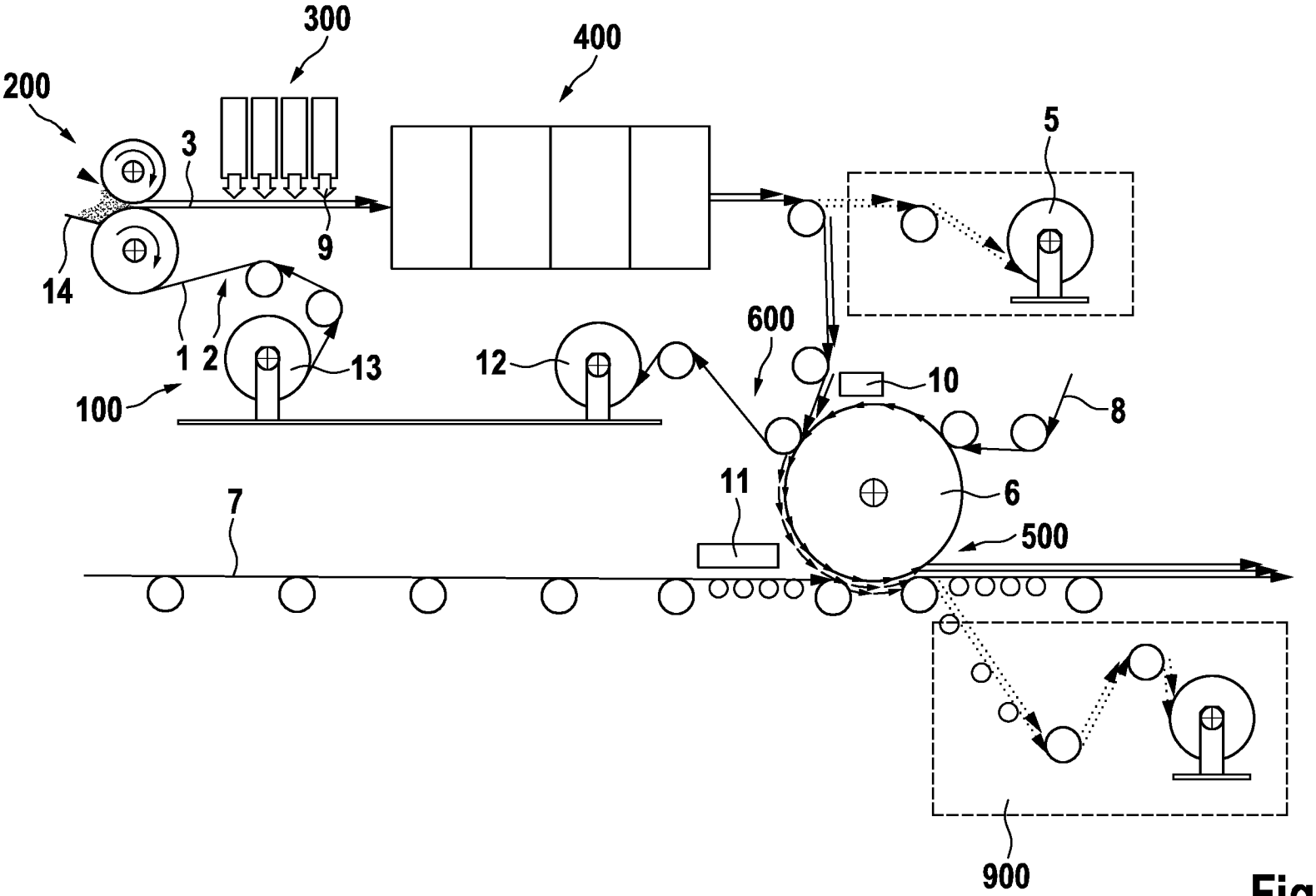
FIG. 1 shows in a schematic view, a first embodiment of a feasible system layout for carrying out the method according to the invention.

In the embodiment shown in FIG. 1, a web-shaped carrier 1 having a release coating 2 and/or a surface with releasing property is provided from an unwind reel 13 in a step 100. The web-shaped carrier 1 with the release coating 2 and/or the surface with the releasing property is fed to a plastisol applying apparatus 14 by means of which a flowable plastisol layer 3 is applied to the release coating 2 and/or the surface with the releasing property in a step 200. Particularly, the plastisol layer 3 is still flowable and has a sol-like quality when it has not yet been gelled or cured.

After the flowable plastisol or lacquer layer 3 has been applied to the release coating 2 and/or the surface with releasing property of the web-shaped carrier 1 in step 200, it is contactlessly printed in its flowable state in step 300. In the present embodiment, for this purpose ink 9 is introduced into the flowable plastisol layer 3 in a digital printing, for example in a laser printing or an ink jet printing. In a subsequent step, 400, the printed plastisol layer 3 is cured. Curing 400 may comprise gelling.

In this way, a printed and cured plastisol or lacquer layer 3 can be provided on a web-shaped carrier 1 and, for example, immediately transported for further processing inline to a laminating device 6 or provided offline, for example by storing the printed plastisol or lacquer layer on a take-up reel 5 for further processing.

In the case of inline processing of the produced printed and cured plastisol layer 3, it can be fed on its web-shaped carrier 1 to a laminating device 6, where in a step 600 the web-shaped carrier 1 is detached and removed from the plastisol layer 3. The web-shaped carrier 1 can be picked up on a take-up reel 12. The web-shaped carrier 1 wound up on the take-up reel 12 can later be reused by re-entering it into the process in step 100.

A clear film 8 is fed to the laminating device 6, onto which clear film the printed side of the plastisol layer 3 is applied and then laminated with the plastisol layer 3 onto a substrate 7, so that the plastisol layer 3 is arranged between the clear film 8 and the substrate 7 in the produced laminate. Using infrared radiation 10, the clear film 8 is optionally heated immediately before being applied to the plastisol layer 3 in order to improve the adhesion of the clear film 8 to the plastisol layer 3. Similarly optionally, in laminating step 500, the substrate 7 fed to the laminating device 6 is heated by the preheating device 11, e.g. an IR radiator, immediately before it comes into contact with the plastisol layer 3, in order to improve the adhesion of the plastisol layer 3 to the substrate 7. The laminating device 6 has a heated roller, which generally has sufficient heat applied to the clear film 8 and substrate 7 to bond the laminate produced.

As is also shown, in an alternative embodiment of the described method, it may be provided that only the plastisol layer 3 and the clear film 8 are joined by the laminating device 6 to form a laminate in laminating step 500 and in particular are not (yet) joined to the substrate 7 to form a three-layer laminate, but instead the two-layer laminate of clear film 8 and plastisol layer 3 is discharged in step 900.

Figure 2:
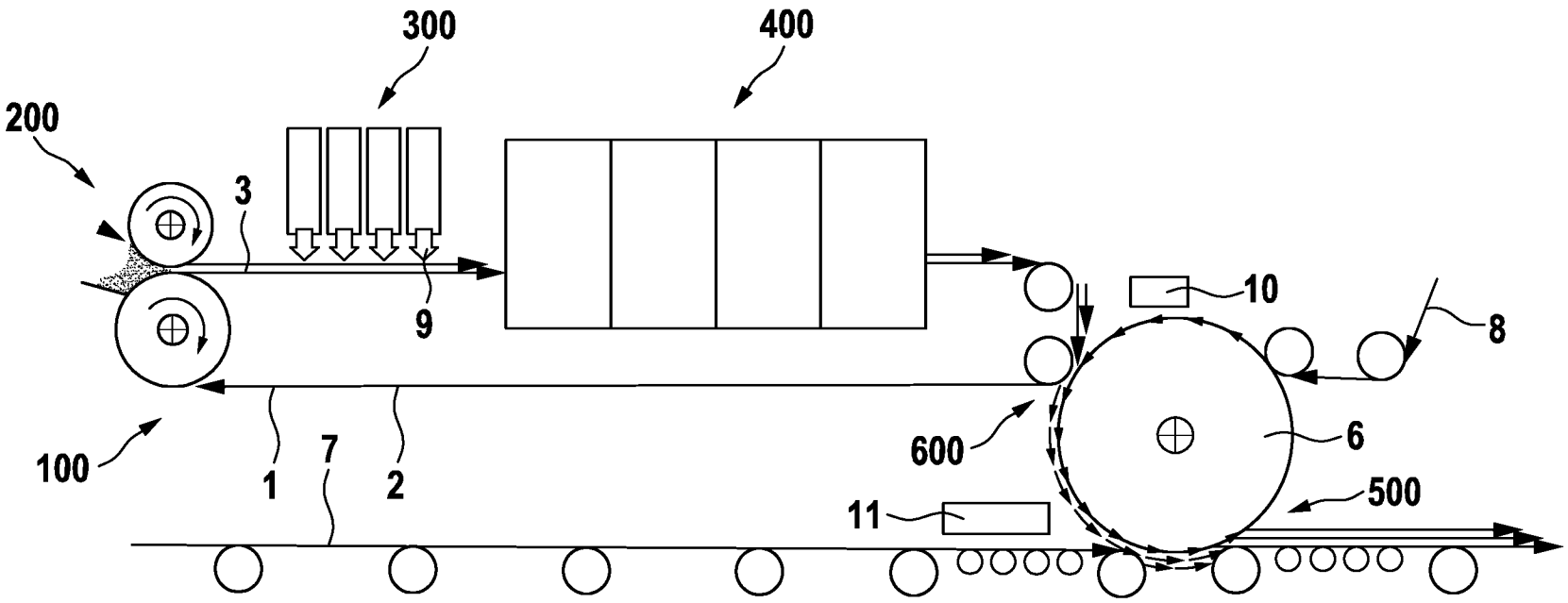
FIG. 2 shows in a schematic view, a second embodiment of a feasible system layout for carrying out the method according to the invention.

The embodiment shown in FIG. 2 differs from the embodiment shown in FIG. 1 in that instead of a web-shaped carrier 1 provided via an unwind reel 13 and picked up again on a take-up reel 12, the web-shaped carrier 1 is provided in the form of a revolving closed transfer belt, which, however, in accordance with the principles of the invention, has on a side facing the plastisol layer 3 a release coating 2 and/or a surface with a releasing property in order to achieve easy detachment of the printed plastisol layer produced on the web-shaped carrier 1 after curing 400.

Figure 3:
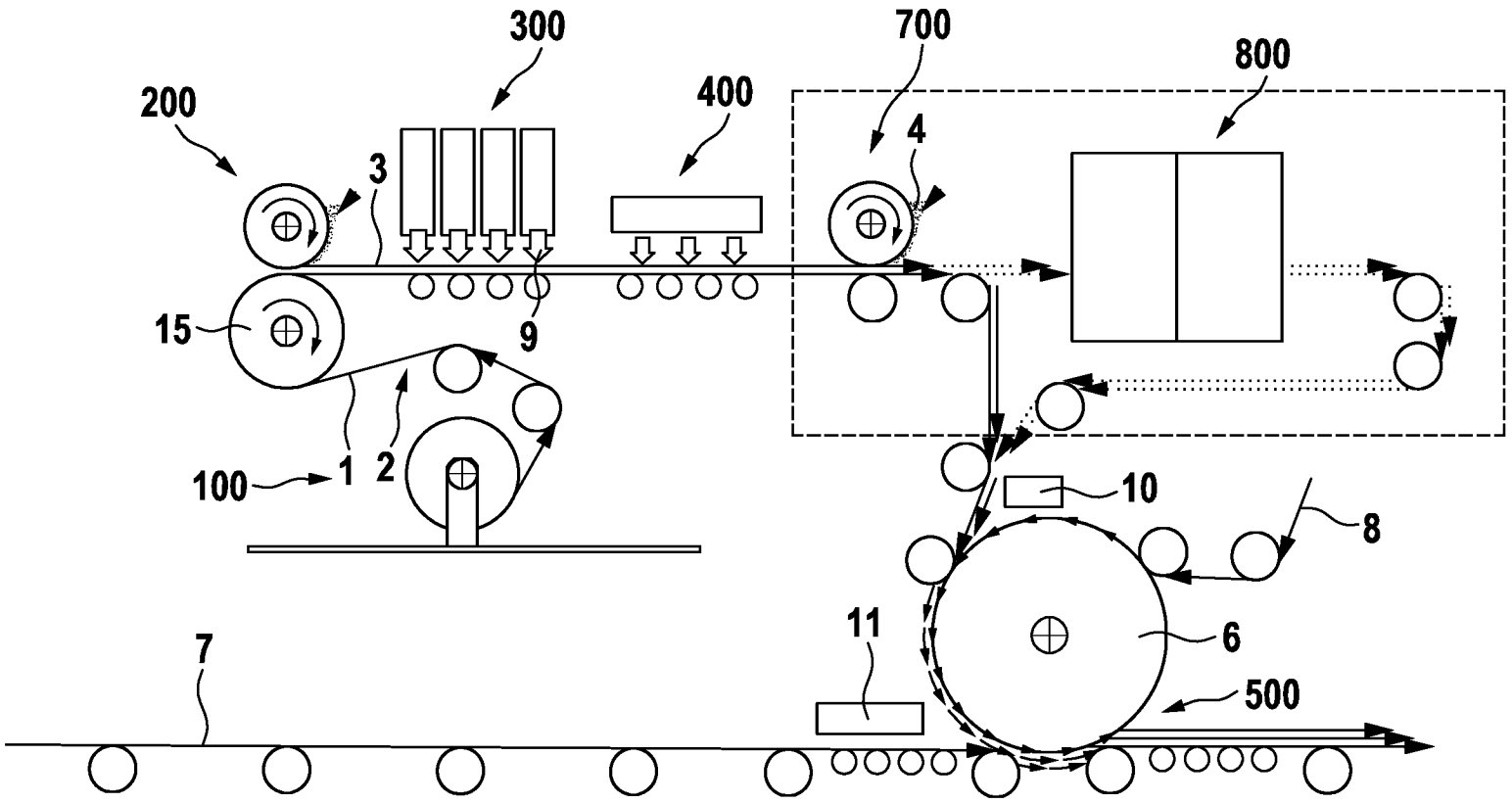
FIG. 3 shows in a schematic view, a third embodiment of a feasible system layout for carrying out the method according to the invention.

The embodiment shown in FIG. 3 differs from the embodiment shown in FIG. 1 in that instead of a plastisol applying unit 14, a UV lacquer applying unit 15 is used to apply a UV lacquer layer 3 to the web-shaped substrate 1 in step 200. After printing the UV lacquer layer in step 300, the still liquid UV lacquer layer is cured by UV radiation in step 400.

In a variant of the embodiment shown in FIG. 3, a step 700 is provided downstream of curing 400 and upstream of laminating 500, in which an adhesion primer 4 is applied to the printed and cured lacquer layer 3 and dried in a subsequent step 800. The adhesion primer 4 is applied to the printed side of lacquer layer 3 and is aimed at improving the adhesion of the printed lacquer layer 3 to the clear film 8.

Figure 4:
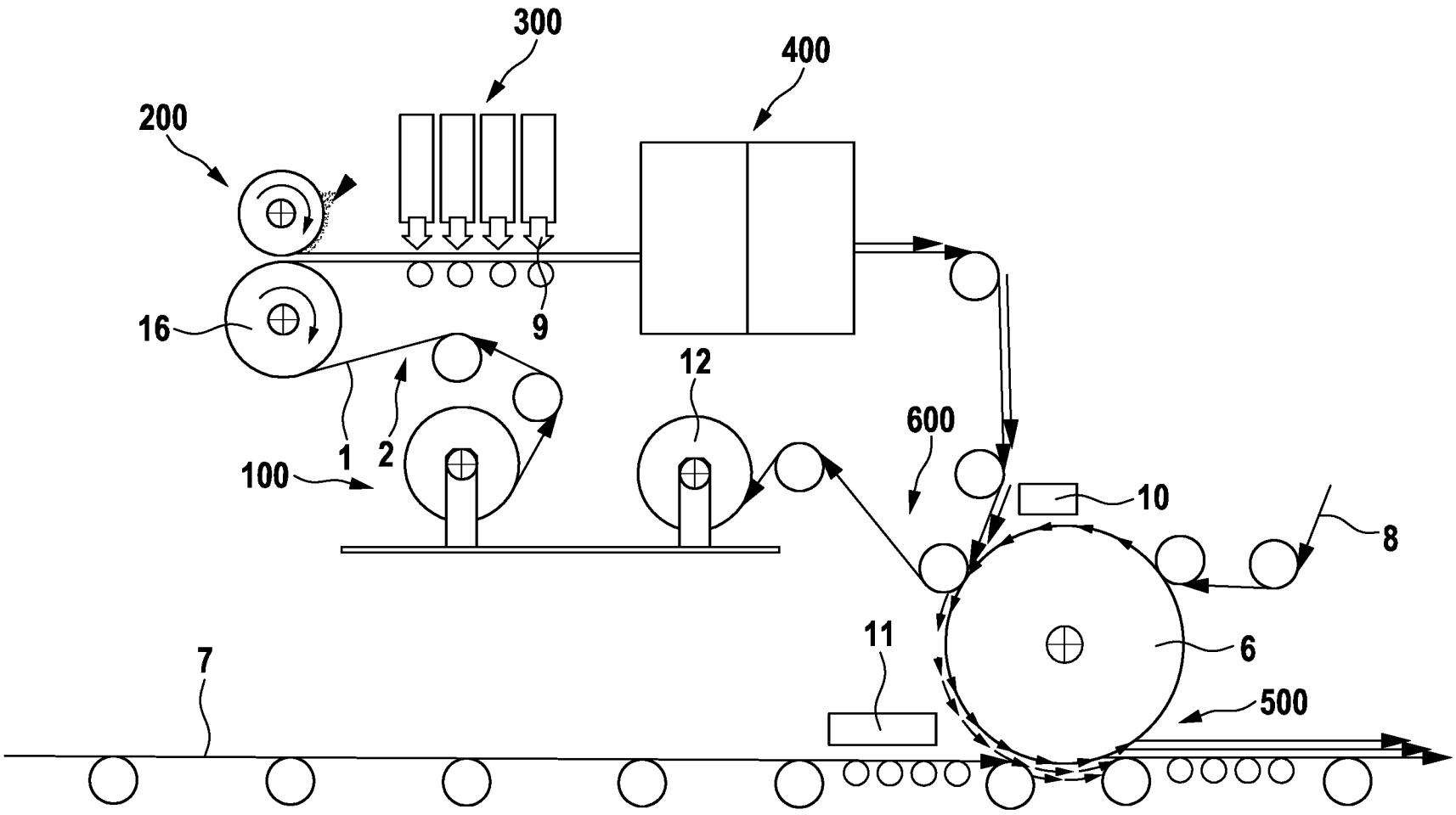
FIG. 4 shows in a schematic view, a fourth embodiment of a feasible system layout for carrying out the method according to the invention.

The embodiment shown in FIG. 4 differs from the embodiment shown in FIG. 1 in that, instead of a plastisol applying apparatus, a lacquer applying apparatus 16 is provided by means of which a lacquer is applied to the release coating 2 and/or the surface with releasing property of the web-shaped carrier 1. According to the principles of the present invention, this lacquer coating 3 is also printed in its still flowable, in particular liquid state in a step 300 by introducing ink 9 and then cured after printing 300 by drying in a step 400. The lacquer can have an aqueous or solvent base.

The features of the invention disclosed in the above description, in the drawings and in the claims may be essential to the realisation of the invention, either individually or in any combination.

The invention claimed is:

1. A method for producing a printed plastisol or lacquer layer, comprising:

providing a web-shaped carrier with a release coating and/or a surface with a releasing property;

applying a flowable, preferably liquid or sol-like plastisol or lacquer layer to the release coating and/or the surface with releasing property;

contactless printing the flowable plastisol or lacquer layer; and curing of the printed plastisol or lacquer layer.

2. The method according to claim 1, in which providing a web-shaped carrier with a release coating and/or a surface with releasing property comprises providing a release liner or a revolving transfer belt.

3. The method according to claim 1, in which, when curing, the printed plastisol or lacquer layer is heated to more than 130° C., preferably to more than 150° C.

4. The method according to claim 1, in which contactless printing the flowable plastisol or lacquer layer comprises a digital printing, such as an inkjet printing or a laser printing.

5. The method according to claim 1, in which, when applying a flowable plastisol or lacquer layer, a UV lacquer layer is applied which is cured by UV radiation after the contactless printing.

6. The method according to claim 1, in which, when applying a flowable plastisol or lacquer layer, a lacquer layer is applied which is cured by drying or chemically crosslinking after the contactless printing.

7. The method according to claim 1, in which after curing the printed plastisol or lacquer layer, an adhesion primer is applied to the printed and cured plastisol or lacquer layer and then dried.

8. The method according to claim 1, in which after curing the printed plastisol or lacquer layer, the web-shaped carrier with the plastisol or lacquer layer applied to it is provided on a take-up reel for subsequent processing.

9. The method according to claim 1, in which after curing, the printed plastisol or lacquer layer on the web-shaped carrier is fed to a laminating device and is laminated onto a substrate using the laminating device.

10. The method according to claim 9, in which before laminating or when laminating, the plastisol or lacquer layer is detached and removed from the web-shaped carrier.

11. The method according to claim 9, in which laminating the plastisol or lacquer layer onto a substrate comprises laminating the plastisol or lacquer layer onto a clear film and/or onto a substrate carrier of a floor covering.

12. The method according to claim 9, in which laminating the printed plastisol or lacquer layer onto the substrate is carried out at a temperature of less than 130° C. and preferably at a temperature of less than 110° C.

13. The method according to claim 1, in which, when printing, an ink is introduced into the flowable plastisol or lacquer layer.

14. The method according to claim 13, in which the flowable plastisol or lacquer layer is a plastisol layer and the curing of the printed plastisol layer comprises gelling the printed plastisol layer, stabilizing the ink in the gelled plastisol layer.

15. The method according to claim 1, in which, when providing a web-shaped carrier with a release coating and/or a surface with releasing property, a siliconised paper, textile or fabric is provided onto which when applying a PVC plastisol is applied, which is gelled after printing when curing.

* * * * *